US012392203B1

(12) United States Patent
Lafleur et al.

(10) Patent No.: US 12,392,203 B1
(45) Date of Patent: Aug. 19, 2025

(54) POWER SWITCH ACTUATOR FOR DOWNHOLE TOOLS

(71) Applicant: Halliburton Energy Services, Inc., Houston, TX (US)

(72) Inventors: Louis Francis Lafleur, Spring, TX (US); Christie Jose, Aberdeenshire (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/443,986

(22) Filed: Feb. 16, 2024

(51) Int. Cl.
*E21B 17/02* (2006.01)

(52) U.S. Cl.
CPC ..... *E21B 17/028* (2013.01)

(58) Field of Classification Search
CPC ..... E21B 17/028
See application file for complete search history.

(56) References Cited

U.S. PATENT DOCUMENTS 3,246,707 A * 4/1966 Bell ..... E21B 43/117 175/4.54
4,520,245 A * 5/1985 Ochsner ..... H01H 35/38 200/82 R
5,155,310 A * 10/1992 Goans ..... H01H 35/38 200/82 C
7,038,151 B2 * 5/2006 Amaduzzi ..... H01H 35/38 200/82 C
8,710,385 B2 * 4/2014 Sickels ..... H01R 13/2421 200/82 R
9,803,430 B2 10/2017 Marcuccio et al.
10,180,049 B1 1/2019 Trafton
10,443,377 B2 * 10/2019 Lafleur ..... E21B 33/122
10,961,827 B2 * 3/2021 Daly ..... F41A 19/13
11,066,908 B2 * 7/2021 Sansing ..... F42D 1/04
11,220,884 B2 1/2022 Robert et al.
11,332,981 B2 5/2022 Lafleur et al.
11,649,695 B2 5/2023 Robert et al.
11,885,215 B2 1/2024 Lafleur
2010/0051440 A1 * 3/2010 Hurst ..... F42C 15/32 200/82 R
2011/0259600 A1 10/2011 Segura et al.
(Continued)

FOREIGN PATENT DOCUMENTS

CN 218971166 U 5/2023
EP 0931906 A2 * 1/1999 ..... E21B 23/08

OTHER PUBLICATIONS

International Search Report and Written Opinion for International Patent Application No. PCT/US2024/018081 dated Nov. 14, 2024. PDF file. 12 pages.

*Primary Examiner* — Aaron L Lembo
(74) *Attorney, Agent, or Firm* — Scott Richardson; C. Tumey Law Group, PLLC

(57) ABSTRACT

In general, in one aspect, embodiments relate to an actuator assembly, that includes a plunger housing, a switch plunger disposed within the plunger housing, and a switch actuator configured to induce linear movement of the switch plunger along the plunger housing, where the actuator assembly is configured to change between an ON position and an OFF position by moving the switch plunger between extended and non-extended positions, and maintain a first pressure at one end of the switch plunger when an outer portion of the actuator assembly is exposed to a second pressure greater than the first pressure.

19 Claims, 8 Drawing Sheets

(56) References Cited

U.S. PATENT DOCUMENTS

| | | | | |
|---|---|---|---|---|
| 2013/0327514 | A1 | 12/2013 | Bonavides et al. | |
| 2016/0230463 | A1* | 8/2016 | Sameei | E21B 31/12 |
| 2016/0251912 | A1 | 9/2016 | Marcuccio et al. | |
| 2018/0328142 | A1 | 11/2018 | Robert et al. | |
| 2022/0090468 | A1 | 3/2022 | Robert et al. | |
| 2022/0205358 | A1 | 6/2022 | Werkheiser et al. | |
| 2023/0349251 | A1* | 11/2023 | Madan | E21B 23/0412 |
| 2024/0352825 | A1* | 10/2024 | Lafleur | F16K 31/06 |

* cited by examiner

POWER SWITCH ACTUATOR FOR DOWNHOLE TOOLS

BACKGROUND

In the oil and gas industry, downhole tools are often battery powered. Oftentimes, a mechanical ON-OFF switch may need to be switched on to connect the on-board battery to the internal electronics of the tool, thereby allowing the battery to power the tool. This generally occurs at the surface prior to deployment into the wellbore and often involves removing a pressure barrier, switching on the mechanical switch, reinstallation of the pressure barrier, and pressure testing thereafter to ensure correct reinstallation of the pressure barrier. Once the tool is ready to be deployed, it is lowered into the wellbore where it arrives at its target depth(s) to perform the tool's intended function.

There is a substantial amount of time in between when the tool is switched on and when the tool actually performs its function in the wellbore. During this time, the activated tool depletes the battery. Batteries generally have only limited operating time, and so tools equipped with greater battery capacities may be required to survive operations with longer run times. Moreover, a specially certified technician is sometimes needed to verify that the electrical components are assembled correctly, and the pressure barrier or seal appropriately installed. Further, cables used to connect electrical components are sometimes assembled with insufficient slack, requiring reassembly which further introduces delay.

Attempts to circumnavigate these problems and postpone toggling of the ON-OFF switch to the ON position include using magnetically actuated switches (Reed Switch), which may remove or eliminate the need for installation/reinstallation of the pressure barrier by allowing an operator to activate a switch from outside the tool. However, the metallic materials used in these types of switches may become magnetized in the wellbore, resulting in switch failure.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
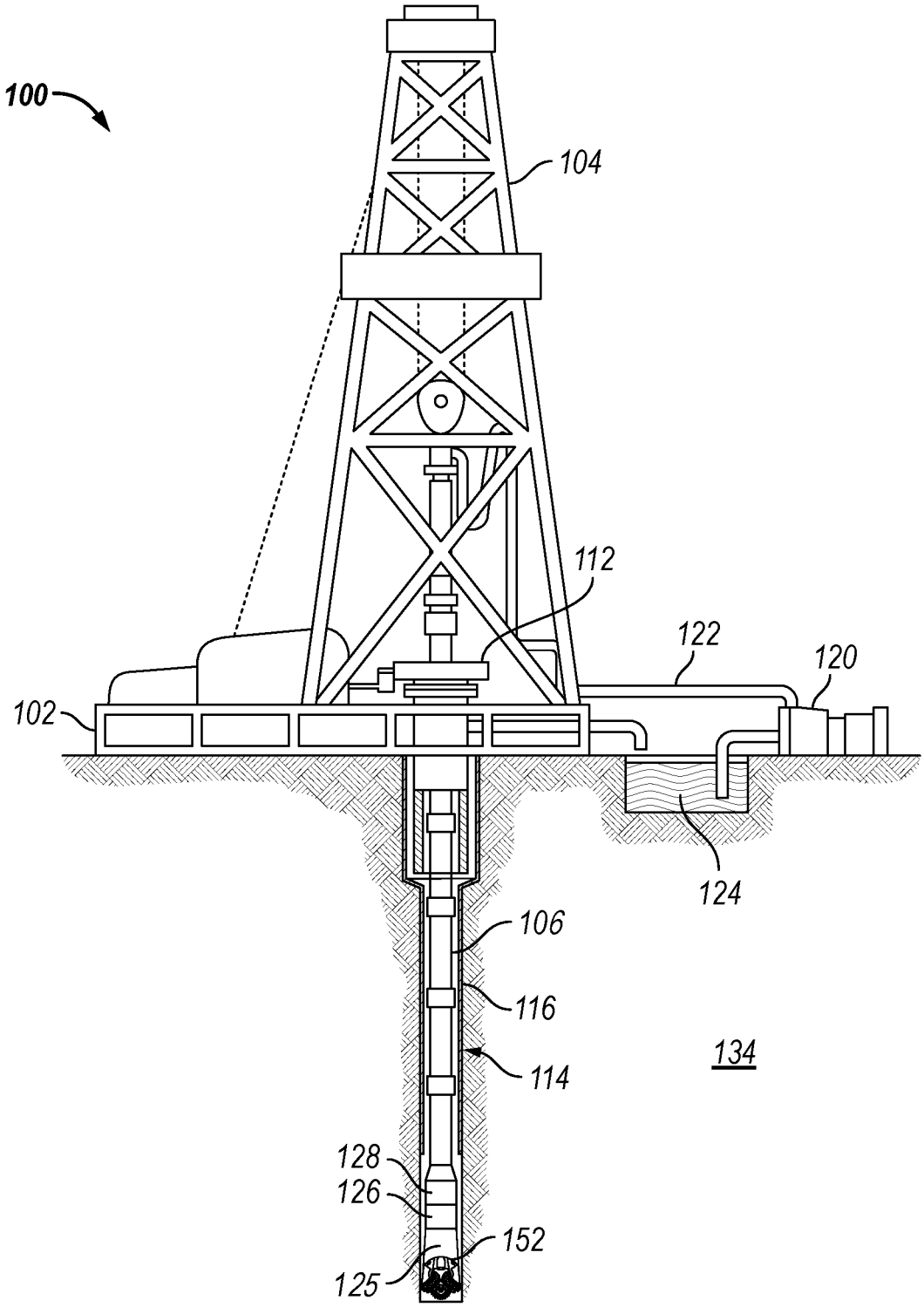
FIG. 1 is a schematic illustration showing a work string in a wellbore having an actuator section and an atmospheric chamber in accordance with some embodiments of the present disclosure.

Disclosed herein is a method of actuating a power switch on a battery-powered downhole tool, and more particularly, disclosed is an actuator assembly for actuating a mechanical switch on a downhole tool.

As used herein, a "downhole tool" or "battery powered downhole tool" is a downhole tool to be disposed in a wellbore and which uses energy stored by one or more batteries on-board the downhole tool. In examples, some or all of the operations performed by a downhole tool may, but need not necessarily be, powered by one or more on-board batteries. For example, a downhole tool may utilize battery power alone, or rely on both a combination of battery power and non-battery power to perform one or more operations.

As alluded to previously, downhole tools may be activated by connecting an on-board battery to internal wiring using a mechanical switch. This usually requires extensive and time-consuming procedures and specialized personnel to ensure that, following activation of the mechanical switch, the tool is pressure sealed to withstand the extreme downhole conditions of the wellbore and to ensure the electrical components are sufficiently isolated from the high-pressure, high-temperature wellbore fluids. Example actuator assemblies and their associated mechanical structures herein disclosed may eliminate the need for disassembly and reassembly of a pressure barrier to activate the mechanical switch. In addition, these may also eliminate the need to perform separate pressure tests following final make-up of a downhole tool, as well as eliminate the need for intermediate cable connectors between the downhole tool and the mechanical switch.

Further, a power switch actuator cartridge, or "cartridge subassembly," may allow the actuator assembly to be actuated and/or a pressure seal to be pressure tested by technicians without specialized certification. Example cartridge subassemblies may also facilitate assembly or disassembly of a downhole tool that includes an actuator assembly.

In examples, the actuator assembly may be characterized as a "powerless actuator," meaning that it may turn on the switch without needing to power the actuator itself. Powerless actuation may involve, for example, manual rotation of a nut, or flange, by personnel at a rig site without the need for assistance of external machinery or a power source.

Other advantages of the present disclosure may include an overall reduction in rig time, reduction in pressure testing requirements, an ability to assemble the downhole tool without the need to disassemble a pressure barrier to access the switch, the ability to turn tools easily and repeatedly on and off, reduction in the size and/or number of batteries, and replaceable packaging. Further advantages may include modular components that can be easily replaced on location, various assemblies and subassemblies that can be assembled and/or rebuilt easily, and scalability of the assemblies and subassemblies to be used on a variety of downhole tools.

FIG. 1 is a schematic diagram of an example drilling or completion environment. Environment 100 may include platform 102 that supports derrick having a traveling block for raising and lowering top drive and work string 114. A top drive may support and rotate work string 114 as it is lowered through wellhead 112. In turn, a drill bit 152, located at the end of work string 114, may create wellbore 116, in some examples. Wellbore 116 may be formed through the Earth surface into a subterranean formation 134 in the Earth crust. Wellbore 116 may be vertical, deviated, horizontal, and/or curved at one or more regions of subterranean formation 134. Wellbore 116 may be cased, open hole, contain tubing, and may generally comprise a hole in the ground, i.e., "borehole", extending any appropriate distance into subterranean formation 134. In one or more examples, one or more regions of the wellbore 116 may be secured at least in part by cement. Servicing rig 104 may be a drilling rig, completion rig, workover rig, or other mast structure supporting work string 114. In some examples, servicing rig 104 comprises a derrick and rig floor through which work string 114 extends downwards into wellbore 116.

While this figure shows work string 114 as a drill string, it should be understood that work string 114 may alternatively comprise various other types of work strings, such as completion strings, perforating strings, workover string, tubing strings, etc. Work string 114 may be equipped to perform any suitable wellbore operation, for example, logging, intervention, drilling, fluid sampling, or the like. Further, although illustrated as being disposed on downhole tool 125 in a drilling operation, downhole tool 125 may also be disposed in wellbore 116 in a wireline operation. Also, while environment 100 is shown as a land-based environment, environment 100 may alternatively be a sea-based environment without departing from the spirit and scope of the disclosure.

Platform 102 is a structure which may be used to support one or more other components of environment 100 (e.g., derrick). Platform 102 may be designed and constructed from suitable materials (e.g., concrete) which are able to withstand the forces applied by other components (e.g., the weight and counterforces experienced by derrick). In any embodiment, platform 102 may be constructed to provide a uniform surface for drilling operations in environment 100.

Derrick is a structure which may support, contain, and/or otherwise facilitate the operation of one or more pieces of the drilling equipment. In any embodiment, derrick may provide support for crown block, traveling block, and/or any part connected to (and including) work string 114. Derrick may be constructed from any suitable materials (e.g., steel) to provide the strength necessary to support those components.

Wellhead 112 is a machine which may include one or more pipes, caps, and/or valves to provide pressure control for contents within wellbore 116 (e.g., when fluidly connected to a well). In any embodiment, during drilling, wellhead 112 may be equipped with a blowout preventer to prevent the flow of higher-pressure fluids (in wellbore 116) from escaping to the surface in an uncontrolled manner. Wellhead 112 may be equipped with other ports and/or sensors to monitor pressures within wellbore 116 and/or otherwise facilitate drilling operations.

Work string 114 is a machine which may be used to carve wellbore 116 and/or gather data from wellbore 116 and the surrounding geology, or else perform other types of wellbore operations (e.g., completion). Work string 114 may include, without limiting to any single embodiment, drill pipe, one or more repeaters, and downhole tool 125, for example. Work string 114 may rotate (e.g., via top drive) to form and deepen wellbore 116 (e.g., via drill bit 152) and/or via one or more motor(s) attached to work string 114, in some examples.

Wellbore 116 is a hole in the ground which may be formed by work string 114 (and one or more components thereof). Wellbore 116 may be partially or fully lined with casing to protect the surrounding ground from the contents of wellbore 116, and conversely, to protect wellbore 116 from the surrounding ground.

Downhole tool 125 is a machine which may be equipped with one or more tools for creating, providing structure, and maintaining wellbore 116, and/or one or more tools for measuring the surrounding environment (e.g., measurement while drilling (MWD), logging while drilling (LWD)). In any embodiment, downhole tool 125 may be disposed at (or near) the end of work string 114 (e.g., in the most "downhole" portion of wellbore 116). In examples, downhole tool 125 may include an actuator assembly 300 for changing a mechanical switch located within atmospheric chamber section 126 between ON and OFF positions, to be discussed in greater detail in later figures.

Non-limiting examples of tools that may be included in downhole tool 125 include a drill bit 152, casing tools (e.g., a shifting tool), a plugging tool, a mud motor, a drill collar (thick-walled steel pipes that provide weight and rigidity to aid the drilling process), actuators (and pistons attached thereto), a completion system (e.g., intelligent completion system), a steering system, and any measurement tool (e.g., sensors, probes, particle generators, etc.).

Further, downhole tool 125 may include a telemetry sub 128 to maintain a communications link with the surface (e.g., with an information handling system). Such telemetry communications may be used for (i) transferring tool measurement data from downhole tool 125 to surface receivers, and/or (ii) receiving commands (from the surface) to downhole tool 125 (e.g., for use of one or more tool(s) in downhole tool 125). In examples, telemetry communications may be at least in part between downhole tool 125 and an information handling system, which may be disposed at a terrestrial surface (or sea-based platform).

An "information handling system," as used herein, may comprise any instrumentality or aggregate of instrumentalities operable to compute, estimate, classify, process, transmit, broadcast, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price.

An information handling system may further include a processing unit (e.g., microprocessor(s), central processing unit(s), etc.) that may process data from downhole tool 125, discussed below, by executing software or instructions obtained from a local non-transitory computer readable media (e.g., optical disks, magnetic disks). The non-transitory computer readable media may store software or instructions of the methods described herein. Non-transitory computer readable media may include any instrumentality or aggregation of instrumentalities that may retain data and/or instructions for a period of time. Non-transitory computer readable media may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing. Information handling system may also include input device(s) (e.g., keyboard, mouse, touchpad, etc.) and output device(s) (e.g., monitor, printer, etc.). The input device(s) and output device(s) provide a user interface that enables an operator to interact with any device disposed or a part of downhole tool 125, discussed below, and/or software executed by a processing unit. For example, information handling system may enable an operator to select analysis options, view collected log data, view analysis results, and/or perform other tasks.

Non-limiting examples of techniques for transferring tool measurement data (to the surface) include mud pulse telemetry and through-wall acoustic signaling. For through-wall acoustic signaling, one or more repeater(s) may detect, amplify, and re-transmit signals from downhole tool 125 to the surface (e.g., to an information handling system), and conversely, from the surface (e.g., from an information handling system) to downhole tool 125.

Work string 114 may include a drill bit 152. Drill bit 152 is a machine which may be used to cut through, scrape, and/or crush (i.e., break apart) materials in the ground (e.g., rocks, dirt, clay, etc.). Drill bit 152 may be disposed at the frontmost point of work string 114 and downhole tool 125. In any embodiment, drill bit 152 may include one or more cutting edges (e.g., hardened metal points, surfaces, blades, protrusions, etc.) to form a geometry which aids in breaking ground materials loose and further crushing that material into smaller sizes. In any embodiment, drill bit 152 may be rotated and forced into (i.e., pushed against) the ground material to cause the cutting, scraping, and crushing action. Rotations of drill bit 152 may be caused by a top drive and/or one or more motor(s) located on work string 114 (e.g., on downhole tool 125).

Environment 100 may include pump 120. Pump 120 is a machine that may be used to circulate drilling fluid from a reservoir, through a feed pipe 122, to derrick, to the interior of work string 114, out through drill bit 152 (through orifices, not shown), back upward through wellbore 116 (around work string 114), back into the reservoir, and to and from mud pit 124, for example. In any embodiment, any appropriate pump 120 may be used (e.g., centrifugal, gear, etc.) which is powered by any suitable means (e.g., electricity, combustible fuel, etc.).

Work string 114 may comprise a conveyance 106 and a downhole tool 125, comprising one or more on-board batteries and/or battery modules. In addition, work string 114 may comprise other downhole tools, such as one or more packers, one or more completion components, e.g., screens and/or production valves, one or more sensing components and/or measuring equipment, e.g., downhole sensors, sampling probes, etc., drilling equipment, the like, or other equipment not shown in FIG. 1. Work string 114 may include, for example, any tool or tool string commonly associated with wellbore operations. While the present figures generally show a single downhole tool 125, work string 114 may comprise any suitable number of downhole tools. For example, downhole tool 125 may comprise a single or a plurality of downhole tools, which may be coupled together on a tool string. As illustrated, downhole tool 125 is attached to conveyance 106 which in this figure is shown as a rigid conduit, but which may alternatively comprise, or be connected to, any suitable form of conveyance such as a wireline, drill string, coiled tubing, stick pipe, etc.

Actuator section 126 is integrated into the downhole tool 125. Actuator section 126 may comprise one or more (e.g., a plurality of) actuator assemblies 300 (e.g., actuator assemblies 300*a* and 300*b* of FIG. 5A). Each actuator assembly 300 (e.g., referring to FIG. 3) of actuator section 126 may be equipped with tools such as the ones shown in FIGS. 4A, 4B to actuate mechanical switch(es) within a respective atmospheric chamber(s) of atmospheric chamber section 126 deep within downhole tool 125. Actuator section 126 may also include one or more cartridge subassemblies, to be discussed in greater detail in later figures.

The atmospheric chamber(s) mentioned above may be disposed within an internal region of downhole tool 125, for example, atmospheric chamber section 126. Downhole tool 125 may comprise an outer housing which may be formed from a heavy metal such as steel, Inconel, etc. Such housing may protect the internal devices (e.g., mechanical switch 208 of FIG. 3A) and the atmospheric chamber(s) of downhole tool 125 from the downhole environment that downhole tool 125 may experience in wellbore 116.

Downhole tool 125 may further include wireless telemetry or logging capabilities, or both, such as to transmit or later provide information indicative of received energy/waveforms to operators on the surface or for later access and data processing for the evaluation of formation 134 properties.

In some embodiments, one or more telemetry devices may communicate with a surface receiver, such as via a wired drill pipe. In other cases, downhole tool 125 may communicate with a surface receiver by wireless signal transmission. In at least some cases, one or more of the actuator section 126 may receive electrical power from a wire that extends to the surface, including wires extending through a wired drill pipe. In at least some instances the methods and techniques of the present disclosure may be performed by a computing device on the surface. In some embodiments, the computing device may be included in surface receiver. For example, surface receiver of wellbore operating environment 100 at the surface may include one or more of wireless telemetry, processor circuitry, or memory facilities, such as to support substantially real-time processing of data received from one or more of the actuator section 126. In some embodiments, data is processed at some time subsequent to its collection, wherein the data may be stored on the surface at surface receiver, stored downhole in telemetry sub 128, or both, until it is retrieved for processing.

In examples, as drill bit 152 extends the wellbore 116 through the formation 134, measurement devices of downhole tool 125 may collect measurements relating to various formation properties as well as the orientation of the tool and various other drilling conditions.

The downhole tool 125 may also include a telemetry sub 128 to transfer measurement data to a surface receiver and to receive commands from the surface. In some embodiments, a telemetry sub 128 may communicate with a surface receiver using mud pulse telemetry. In other cases, a telemetry sub 128 does not communicate with the surface, but rather stores logging data for later retrieval at the surface when the logging assembly is recovered. Notably, downhole tool 125 may also operate using a non-conductive cable (e.g., slickline, etc.) with a local power supply, such as batteries and the like. When employing non-conductive cable, communication may be supported using, for example, wireless protocols (e.g., EM, acoustic, etc.) and/or measurements and logging data may be stored in local memory for subsequent retrieval at the surface, as is appreciated by those skilled in the art.

Figure 2:
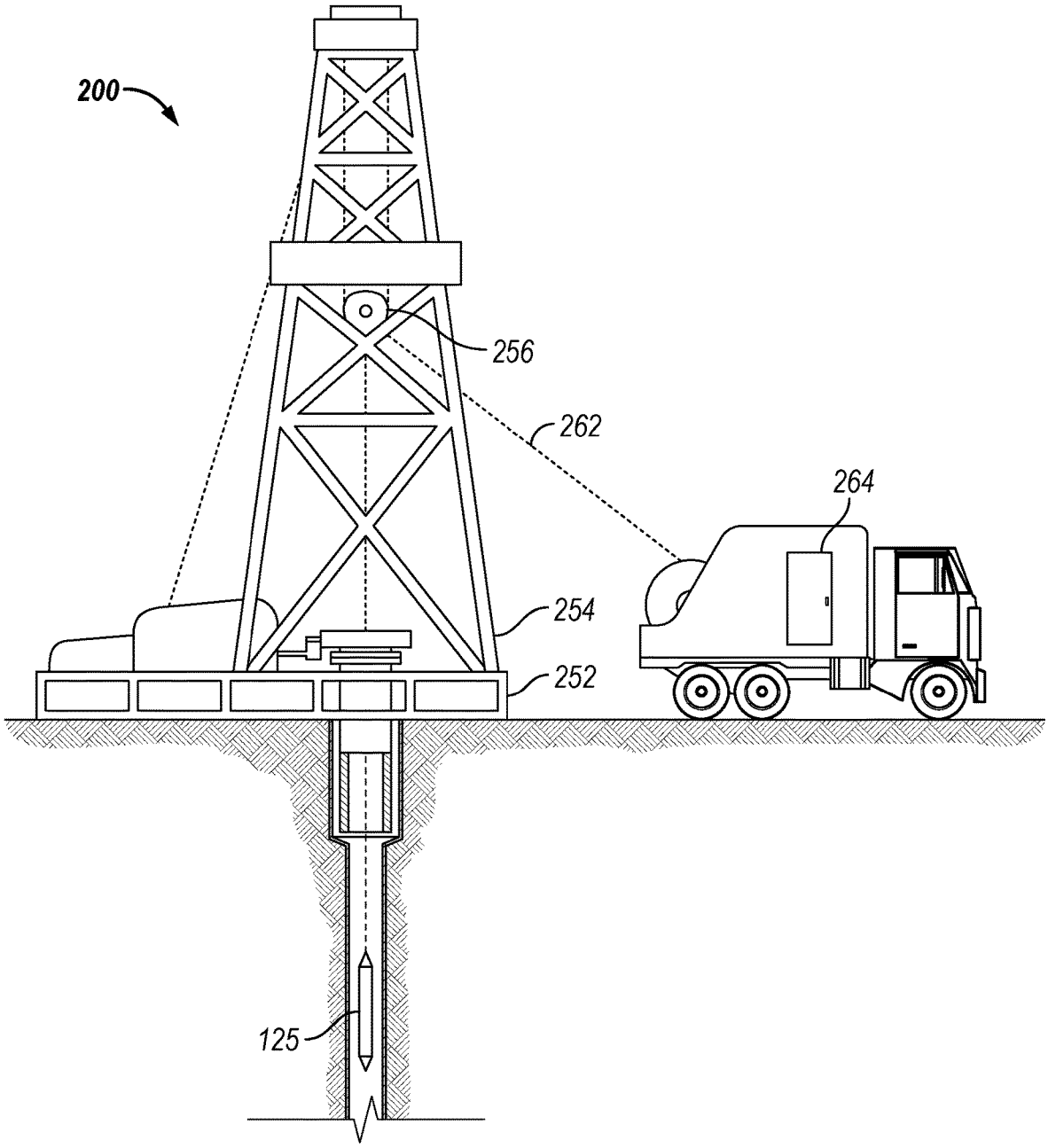
FIG. 2 is a schematic illustration showing a downhole tool on a conveyance in a wellbore in accordance with some embodiments of the present disclosure.

FIG. 2 illustrates a diagrammatic view of a conveyance logging wellbore operating environment 200 in which the present disclosure may be implemented. As depicted in FIG. 2, hoist 256 may be included as a portion of platform 252, such as that coupled to derrick 254, and used with a conveyance 262 to raise or lower equipment such as downhole tool 125 into or out of a borehole. A conveyance 262 may provide a communicative coupling between the downhole tool 125 and a logging facility 264 at the surface. Conveyance 262 may include wires (one or more wires), slicklines, cables, or the like, as well as tubular conveyances such as coiled tubing, joint tubing, or other tubulars, and may include a downhole tractor. Additionally, power can be supplied via conveyance 262 to power the tool. The downhole tool 125 may have a local power supply, such as batteries, downhole generator, and the like. As with FIG. 1, downhole tool 125 may also have an actuator section 126 (e.g., referring to FIG. 1) as well as an atmospheric chamber section 126 (e.g., referring to FIG. 1). These may likewise house, or be attached to, respective actuator assemblies (e.g., actuator assemblies 300*a*, 300*b*, etc. of FIG. 5A) each configured to actuate a respective mechanical switch (e.g., mechanical switch 208 of FIG. 3) disposed within atmospheric chamber section 126. When employing non-conductive cable, coiled tubing, pipe string, or downhole tractor, communication may be supported using, for example, wireless protocols (e.g., EM, acoustic, etc.), and/or measurements and logging data may be stored in local memory for subsequent retrieval.

Figure 3B:
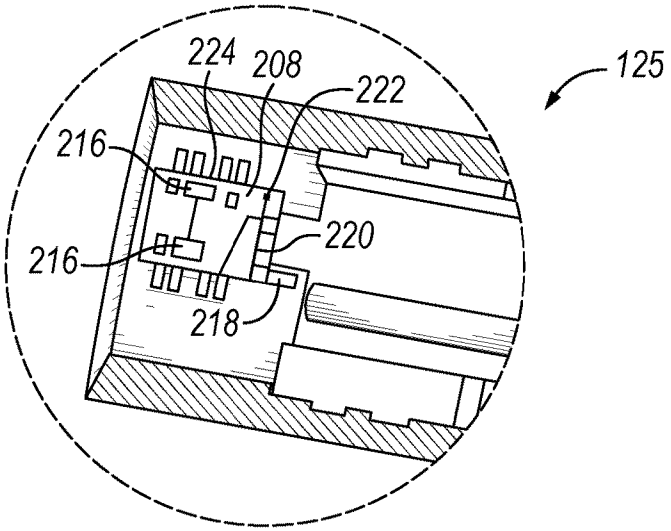
FIG. 3B illustrates a close-up view of the actuator assembly of FIG. 3A to show a mechanical switch in accordance with some embodiments of the present disclosure.
Figure 3A:
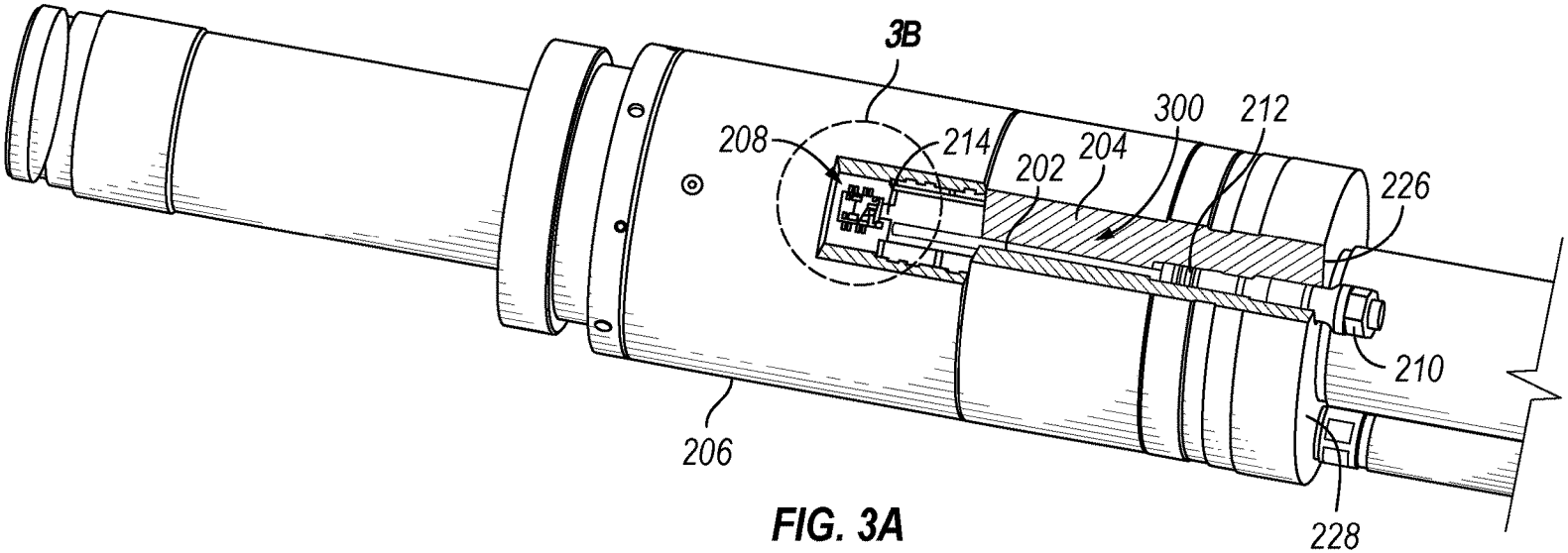
FIG. 3A illustrates a partially cut-out view of part of a tool string to show an actuator assembly in accordance with some embodiments of the present disclosure.

FIG. 3A illustrates a partially cut-out sectional view of part of a tool string to show an actuator assembly 300 in accordance with some embodiments of the present disclosure. In general, actuator assembly 300 is configured to actuate a mechanical switch disposed within the downhole tool 125 by moving the switch between OFF and ON positions via linear and/or rotational movement of a switch plunger 202. As mentioned, the particular configuration of the actuator assembly 300 and its related structures may ensure that there remains a seal during and after switch activation.

Actuator assembly 300 comprises a switch plunger 202 extending lengthwise through an internal region 204 of downhole tool 125 disposed within a housing 206 thereof. Switch plunger 202 is a rod, shaft, linear piston, or other linear element that may move along the length of plunger housing 308 to actuate mechanical switch 208. The purpose of switch plunger 202 is to allow actuator assembly 300 to actuate mechanical switch 208 over a distance spanning the length of switch plunger 202 such that mechanical switch 208 is safely isolated within the downhole tool 125 (e.g., referring to FIG. 1) away from the wellbore environment. Switch plunger 202 may have any suitable length including, for example, a length from about 0.5 feet (ft) to about 4.5 ft, or any ranges therebetween. In examples, switch plunger 202 has a sufficient length to allow for actuation of mechanical switch 208 from outside downhole tool 125, such as via rotation of a switch actuator 210. Notably, mechanical switch 208 is embedded deep within the downhole tool 125 to isolate it from external forces (e.g., vibration). Namely, this eliminates the need for cantilevered parts typically required for minimizing vibrational effects associated with downhole use of downhole tool 125.

Actuation of mechanical switch 208 may involve rotating of switch actuator 210 to cause switch plunger 202 to move closer to mechanical switch 208 until mechanical switch 208 is toggled to an ON position, which may connect internal wiring of downhole tool 125 to one or more batteries, thereby powering the downhole tool 125. In examples, actuation of actuator assembly 300 may be achieved while maintaining a constant or nearly constant pressure (e.g., variation less than +/−5 pounds per square inch (psi), +/−1 psi, +/−0.1 psi, or ranges therebetween) at the region housing mechanical switch 208 during actuation.

Housing 206 may comprise or be an outer sleeve which may in some examples be configured to open to allow access to mechanical switch 208 from the outside. Part or all of housing 206 may be slidable so that opening of housing 206 comprises sliding (e.g., slidable sleeve 414) to reveal mechanical switch 208, or may comprise a removable panel, hatch, door, or the like, to allow access to mechanical switch 208, for example. Housing 206 may be formed from a heavy metal such as steel, Inconel, etc. Such housing may protect the internal devices (e.g., mechanical switch 208 of FIG. 3A) and the atmospheric chamber(s) of downhole tool 125 from the downhole environment that downhole tool 125 may experience in wellbore 116 (e.g., referring to FIG. 1).

FIG. 3B illustrates a close-up view of the actuator assembly 300 of FIG. 3A to show mechanical switch 208 in accordance with some embodiments of the present disclosure. In this example, mechanical switch 208 is a device disposed within an inner region of downhole tool 125 by a pair of screws 216. A surface 218 of mechanical switch 208 may interface with switch plunger 202 to cause mechanical switch 208 to close part of a circuit involving downhole electronics of downhole tool 125 and battery/ies, such as by pushing a button 222 with a flexible plate 220 attached to surface 218. In the illustrated example, mechanical switch 208 may comprise a plurality of wire connectors 224 to electrically couple various electrical components of the downhole tool 125 to mechanical switch 208.

While only a single actuator assembly 300 is shown by FIGS. 2A and 2B, downhole tool 125 may house a plurality of actuator assemblies and mechanical switches, and thus a plurality of switch actuators 210 may extend out from surface 228 through respective apertures 226 circumferentially disposed on surface 228 of housing 26 about a central axis of downhole tool 125.

Figure 4A:
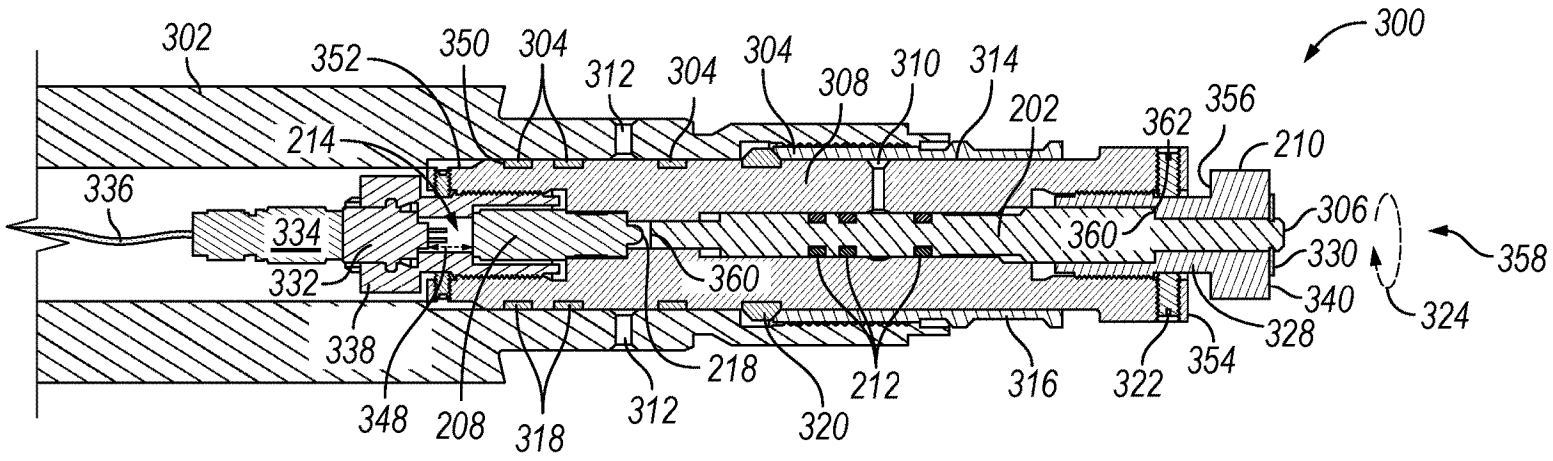
FIG. 4A shows a schematic illustration of an actuator assembly in a pressure housing with the mechanical switch in an OFF position in accordance with some embodiments of the present disclosure.

FIG. 4A shows a schematic illustration of an actuator assembly 300 in a pressure housing 302 of a with the mechanical switch in an OFF position in accordance with some embodiments of the present disclosure. As illustrated, actuator assembly 300 is disposed in pressure housing 302, which functions to isolate region 214 from wellbore pressure at surface 306. Region 214 may thus be characterized as an "atmospheric chamber" in some examples and may be at atmospheric pressure even when downhole tool 125 (e.g., referring to FIG. 1) is disposed at extreme depths downhole, e.g., between 1,000 and 30,000 feet, or any ranges therebetween.

In this example, actuator assembly 300 comprises a switch plunger 202 disposed in a plunger housing 308 having a pressure test port 310. As shown, at least a portion of switch plunger 202 may extend out from actuator assembly 300 such that in some examples, a surface 306 may be exposed to the wellbore environment when the tool is disposed downhole. On the other end opposite surface 306, switch plunger 202 has a contact surface 307 for contacting mechanical switch 208. In alternative embodiments where actuator assembly 300 comprises one or more electrical leads, switch plunger 202 may actuate the tool by closing an electrical circuit, which may displace the need for a mechanical switch. For example, the actuator assembly 300 (e.g., switch plunger 202) may contact positive and negative electrical leads to complete/close an electrical circuit.

Plunger housing 308 is an annular housing that in some examples may house switch plunger 202. In examples, plunger housing 308 may encompass most of the length spanned by switch plunger 202 and may also extend beyond the contact surface 307 to also encompass mechanical switch 208 and at least a portion of connector 332. Plunger housing 308 may also have one or more annular grooves 350 radially disposed on its outer surface 352 for holding one or more respective annular sealing elements 318 (e.g., sealing rings). On the wellbore-facing side 358 of actuator assembly 300, plunger housing 308 may have a surface 354 oriented to seat against an underside 356 of switch actuator 210 or an element (e.g., shipping spacer) disposed therebetween. Plunger housing 308 may have any suitable shape and may include one or more shoulders ("travel stop") for receiving corresponding interfacing surfaces of switch plunger 202, to be discussed later.

Switch actuator 210 is another device (e.g., annular member) of actuator assembly 300 for actuation a mechanical switch. In examples, switch actuator 210 may comprises a flanged portion and a plunger driver 328. The outer flanged portion may be configured to rotate. Plunger driver 328 may have a shoulder 360 configured to interface with a contact surface 362 of switch plunger 202, whereby linear movement along plunger housing 308 as switch actuator 210 rotates is imparted to switch plunger 202 to move plunger driver 328 towards mechanical switch 208 during actuation.

Snap ring 330, or "retaining ring," may be disposed around and end of switch plunger 202 at the wellbore-facing side 358 of actuator assembly 300. Snap ring 330 may ensure plunger driver 328 remains attached to switch actuator 210 when plunger driver 328 and switch actuator 210 are rotated to pull plunger driver 328 towards wellbore-facing side 358 away from switch 208, e.g., when mechanical switch 208 is switched to an OFF position.

Switch 208 may connect via a connector 332 and a wiring harness 334 to wiring 336. Wiring 336 may be coupled to a resistive load associated with a function of downhole tool 125 (e.g., referring to FIG. 1), e.g., internal electronics, so that when mechanical switch 208 is activated, the internal electronics of the tool are powered.

In one or more examples, an annular member 338 at least partially disposed in plunger housing 308 may separate connector 332 from switch 208 by a distance 348. Distance 348 may be unchanged by actuation of actuator assembly 300. In examples, this may further guarantee that the connection between mechanical switch 208 and connector 348 remains undisturbed by actuation of the actuator assembly 300.

In some examples, another pressure test port 312 may be disposed in pressure housing 302. These pressure test ports 310, 312 may be used to conduct pressure surveys of regions within actuator assembly 300 and/or pressure housing 302 to quickly verify that the isolated regions within downhole tool 125 (e.g., referring to FIG. 1), e.g., region 214, are properly sealed off from the outside. A pressure test may involve, for example, pressurizing one of these test ports and determining whether or not the pressure declines over time or remains stable. A drop in pressure would indicate leakage and improper scaling by annular sealing elements 212 or 318. In other examples, however, no pressure tests are required as the annular sealing elements 212 and 318 may sufficiently guarantee region 214 is isolated from wellbore pressures at surface 306.

This figure also shows a cartridge subassembly 304 which is disposed on the outer surface 314 of plunger housing 308, and which may comprise spin collar 316 and annular sealing elements 318, 320 (e.g., scaling rings). Split ring 320 may have an irregular (e.g., polygonal) cross section and protrude some distance out from surface 314, as shown. When spin collar is installed on plunger housing 308 (from left to right in this figure) (e.g., prior to installation of actuator assembly 300 within pressure housing 206), split ring 320 restrains spin collar 316 on plunger housing 308 as split ring 320 may be compressed into a depressed configuration by the inner diameter of spin collar 316. Once spin collar 316 is set at a desired position within pressure housing 206, actuator assembly 300 may be pushed so that split ring 320 slides past spin collar 316 where it expands into a respective annular groove of pressure housing 206.

Cartridge subassembly 304 may be disposed between actuator assembly 300 and pressure housing 302. An advantage associated with cartridge subassembly 304 may be improved ergonomics during assembly since it may allow, in some examples, for different regions of the downhole tool 125 (e.g., referring to FIG. 1) to be pressure tested in different stages of assembly. For example, a first assembly stage may comprise disposing cartridge subassembly 304 within pressure housing 302, and a second assembly stage may comprise disposing actuator assembly 300 within cartridge subassembly 304. Alternatively, a first assembly stage may comprise first disposing actuator assembly 300 within cartridge subassembly 304 with the second stage comprising disposing the combined actuator assembly and cartridge subassembly in the pressure housing 302.

Figure 4B:
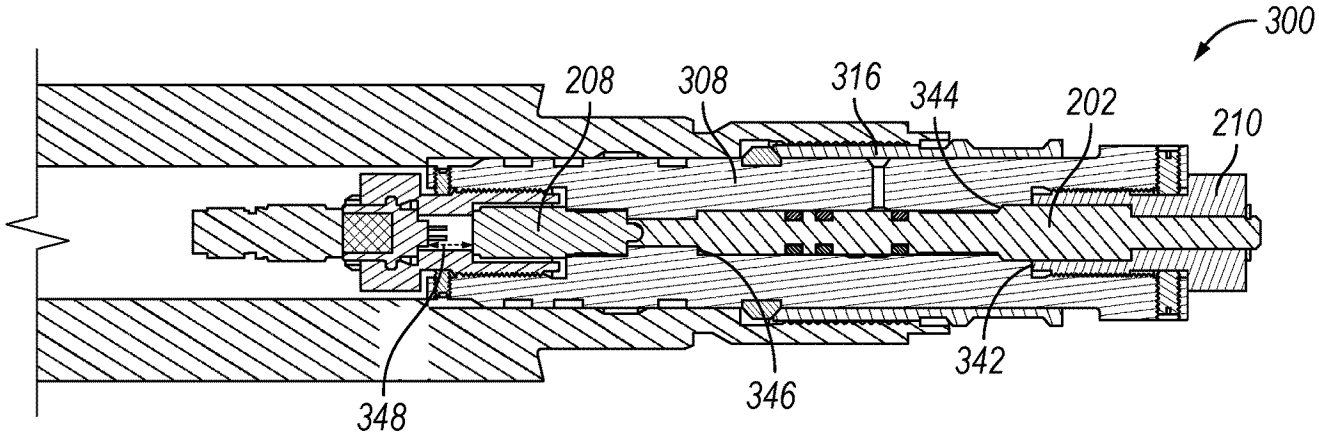
FIG. 4B shows the schematic illustration of the actuator assembly of FIG. 5A with the mechanical switch in an ON position in accordance with some embodiments of the present disclosure.

Anti-rotation screws 322 may be used to prevent rotation of actuator assembly 300 when actuation of mechanical switch 208 is not desired. In some examples, actuation may involve removing or loosening of anti-rotation screws 322 followed by rotation of switch actuator 210 as indicated by an arrow at 324. Accordingly, FIG. 4B shows the schematic illustration of the actuator assembly 300 of FIG. 4A with the mechanical switch in an ON position in accordance with some embodiments of the present disclosure.

To actuate actuator assembly 300, anti-rotation screws 322 (e.g., referring to FIG. 4A) are first removed to allow switch actuator 210 to rotate. This may cause switch plunger 202 to depress contact surface 218 (e.g., referring to FIG. 4A) of mechanical switch 208. One or more internal surfaces of actuator assembly 300 may function as a travel stop to prevent over-rotation of switch actuator 210 and thus over-insertion of switch plunger 202 at the interface with switch 208. For example, respective interfacing surfaces indicated at 342, 344, and/or 346 may function to stop extension of switch plunger 202 in actuator assembly 300, to use non-limiting examples, when switch actuator 210 is fully rotated into the ON position. In addition, the rate and/or amount of insertion may be controlled by threads or spiral tracks which may be disposed on inner and outer surfaces of plunger housing 308 and switch plunger 202, respectively, in some examples. Threads or tracks may be additionally, or alternatively placed at the respective interfacing surfaces of spin collar 316 and plunger housing 308 to achieve the same effect. Thus, the amount of depression applied to a contact surface 218 of mechanical switch 208 may the same each time actuator assembly 300 is fully actuated based on the location of the one or more stops and/or threads/tracks.

Figure 5A:
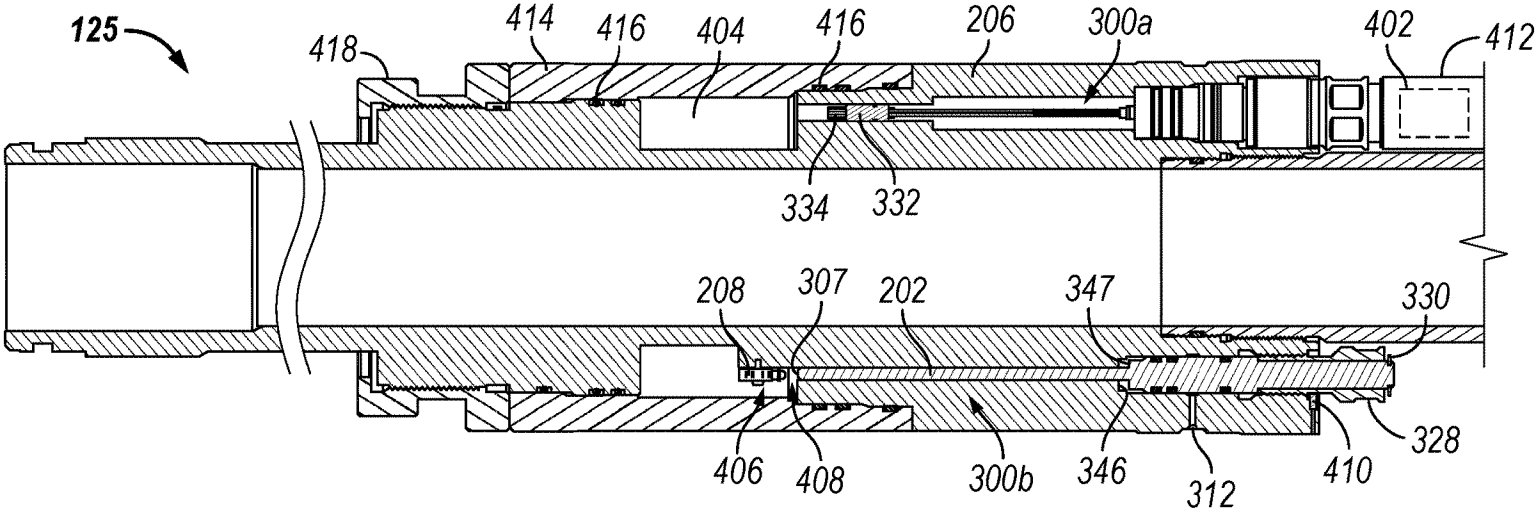
FIG. 5A shows a downhole tool including the actuator assembly disposed bilaterally on either side of the downhole tool and in respective OFF positions in accordance with some embodiments of the present disclosure.

FIG. 5A shows part of a downhole tool 125 including two of the actuator assembly 300 disposed bilaterally on either side of the downhole tool 125 and in respective OFF positions in accordance with some embodiments of the present disclosure. While FIG. 5A only shows two of these assemblies, any suitable number may be included with downhole tool 125, for example, between 1 and 15, or any ranges therebetween. These may be disposed circumferentially about a central axis of downhole tool 125 as mentioned, or in any suitable configuration. In this example, a battery module 402 is connected to actuator assembly 300 and may provide power to downhole tool 125. Battery module 402 may comprise any arrangement or configuration of one or more batteries, which may be disposed within a housing 412 of battery module 402. Batteries of battery module 402 may power, for example, a downhole PCB, pressure and/or temperature gauges, electrically actuated flow control valves, an electrically actuated pyrotechnic charge to initiate a tool release mechanism, telemetry devices e.g., signal repeater, combinations thereof, or the like, to use non-limiting examples. In examples, battery module 402 may be wired to a downhole PCB assembly that controls power distribution to a plurality of on-board devices, e.g., one or more of those listed above.

Also notated by this figure is an atmospheric chamber 404, connector 332 to wiring harness 334, snap ring 330, and pressure test port 312. Mechanical switch 208 may be disposed within atmospheric chamber 404, in some examples. Importantly, this view also shows an example of a shoulder 346 ("travel stop"), which is designed to catch a respective seating surface 347 of switch plunger 202. In examples, switch plunger 202 has a stepped profile, e.g., shoulder, to facilitate seating of seating surface 347 against shoulder 346 (e.g., as shown by FIG. 5B).

As mentioned, housing 206 may be configured to slide open to expose atmospheric chamber 404 such as via sliding of a removeable sleeve 414 concentrically disposed about housing 206. A plurality of annular sealing elements 416 (e.g., O-rings), disposed between removeable sleeve 414 and housing 206 above and below atmospheric chamber 404, may be used to ensure a good pressure seal between atmospheric chamber and the downhole environment of wellbore 116 (e.g., referring to FIG. 1), such as the three shown by FIG. 5A. A locking member 418 may be removably installed below sleeve 414 to lock removeable sleeve 414 in place when it is installed over atmospheric chamber 404, and may thus abut, or be substantially adjacent to, slidable sleeve 414. Locking member 418 may be threaded onto housing 206, and there may include additional anti-rotation screws threaded therethrough to prevent vibration from loosening locking member 418. As with other members of downhole tool 125, locking member 418 and/or removeable sleeve 414 may be formed from a heavy metal such as steel, Inconel, etc.

An OFF position 406 may comprise a gap 408 formed between an contact surface 307 of switch plunger 202 and mechanical switch 208. Gap 408 in the OFF position 406 may be any suitable distance, for example, between 0.01 centimeters and 10 centimeters, or any ranges therebetween. One or more anti-rotation screws 410 may be used to secure the axial and/or radial orientation of actuator assembly 300 by preventing axial drift of switch plunger 202 along a length of actuator assembly 300. These may be installed at any point during assembly such as, for example, after mechanical switch 208 is switched to an ON position (e.g., ON position 413 of FIG. 5B).

Figure 5B:
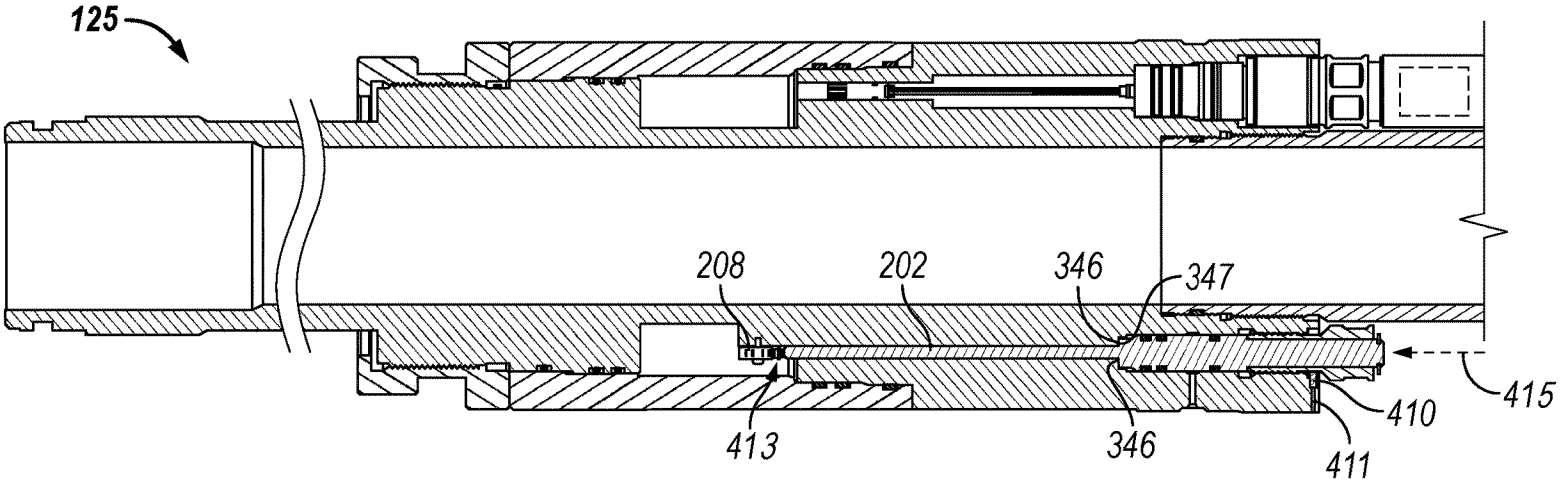
FIG. 5B shows the downhole tool of FIG. 5A with the respective actuator assemblies in respective ON positions in accordance with some embodiments of the present disclosure.

Accordingly, FIG. 5B shows the downhole tool 125 of FIG. 5A with the respective actuator assemblies 300 in respective ON positions 413 in accordance with some embodiments of the present disclosure. As illustrated, an ON position 413 may comprise removal of gap 408 (e.g., referring to FIG. 5A) such that an end of switch plunger 202 contacts a contact surface 218 (e.g., referring to FIG. 3) of mechanical switch 208. In this position, seating surface 347 is seated against shoulder 346 to limit over-insertion of switch plunger 202 into switch 208, as shown.

In addition, or alternatively to shoulder 346, anti-rotation screw 410 may be set within a respective port 411 to engage plunger driver 328. Wellbore pressure indicated by an arrow at 412 which might otherwise cause axial drift of switch plunger 202 along the tool and thus over-insertion and/or damage to the mechanical switch 208 may be counteracted by one or more additional anti-rotation screws 410. Once set, anti-rotation screw 410 is designed to prevent the drift and thus prevent damaging of mechanical switch 208.

Figure 6A:
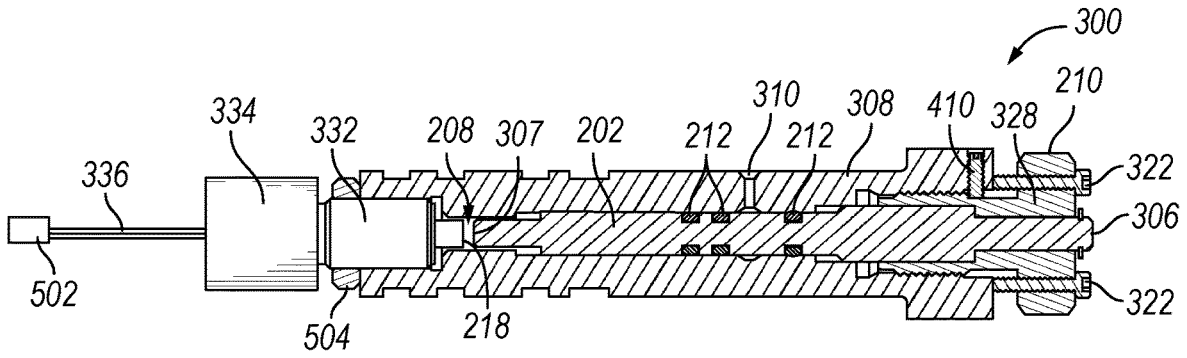
FIG. 6A is a cross-sectional view of an actuator assembly in an OFF position in accordance with some embodiments of the present disclosure.

FIG. 6A is a cross-sectional view of an actuator assembly 300 in an OFF position in accordance with some embodiments of the present disclosure. In the illustrated example, pressure test port 310 is disposed at a point approximately halfway between ends 306, 307 of switch plunger 202. Annular sealing elements 212 are shown being disposed on switch plunger 202 on either side of pressure test port 310, such that at least two seals are downhole pressure test port 310 and at least one uphole pressure test port 310, in this example. This may more securely isolate one or more regions downhole pressure test port 310, as well as ensure that a pressure test is accurate. Also visible in this figure are anti-rotation screws 322 and 410, as well as mechanical switch 208, connector 332, and wiring harness 334, previously discussed. In this manner, mechanical switch 208 may be electrically coupled to an electrical connection point 502 via wiring 336. Rotation of plunger driver 328 attached to switch actuator 210 may impart linear movement along the length of housing 308 to switch plunger 202 such that it actuates mechanical switch 208, as discussed. An ON-OFF switch jam nut may fix the position of connector 332 and/or mechanical switch 208 relative to switch plunger 202, thereby ensuring pressure applied to contact surface 218 does not cause these components to shift when switch plunger 202 is actuated. This Figure also shows an annular element (e.g., flange) disposed about a region of the tool containing connector 332.

Figure 6B:
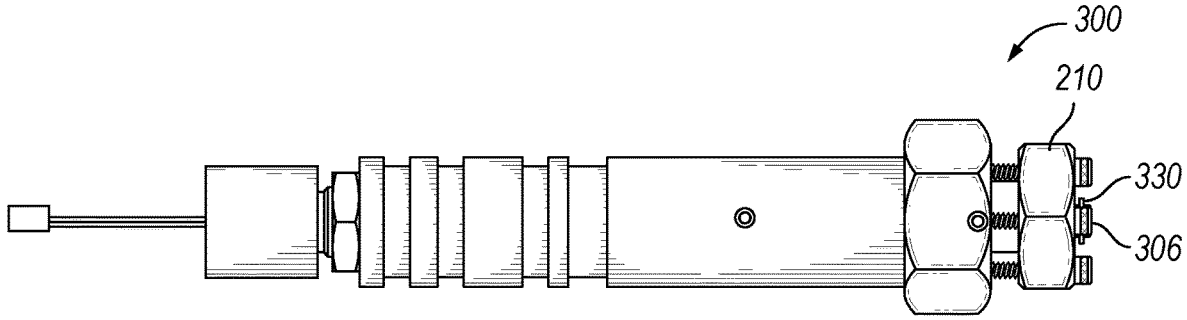
FIG. 6B shows a perspective view of the actuator assembly of FIG. 7A in accordance with some embodiments of the present disclosure.

FIG. 6B shows a perspective view of the actuator assembly 300 of FIG. 6A in accordance with some embodiments of the present disclosure. During disassembly, snap ring 330 installed at or near uphole surface 306 allows switch actuator 210 to exert upward pressure on switch plunger 202 as switch actuator 210 is rotated away from away from contact surface 218 (e.g., referring to FIG. 6A). Disassembly may further comprise removal of anti-rotation screws 322 prior to rotation to allow switch actuator 210 to separate from a flanged portion 506 of housing 308.

Figure 6C:
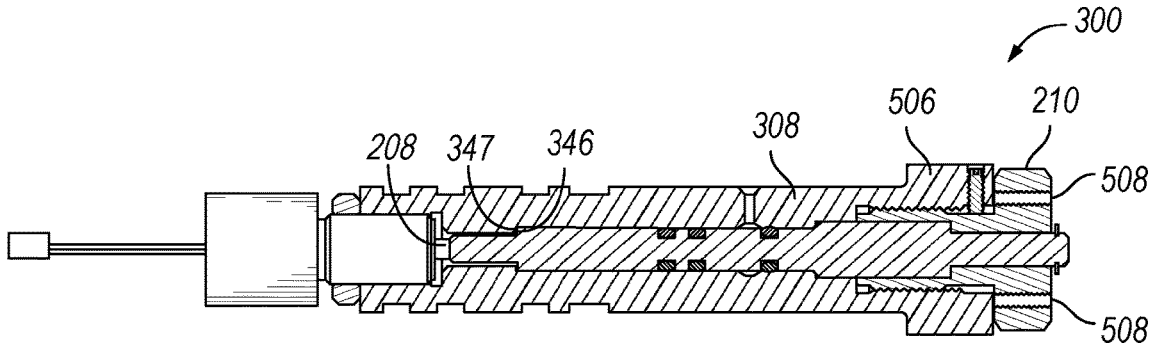
FIG. 6C is a cross-sectional view of the actuator assembly of FIG. 7A but in an ON position in accordance with some embodiments of the present disclosure.

FIG. 6C is a cross-sectional view of the actuator assembly 300 of FIG. 6A but in an ON position in accordance with some embodiments of the present disclosure. As illustrated, anti-rotation screws 322 (e.g., referring to FIGS. 5A, 5B) are removed from their respective ports 508 and switch actuator 210 is moved closer to flanged portion 506 of housing 308. Also visible in this figure is a more depressed configuration of mechanical switch 208 relative to that shown by FIG. 6A, as well as shoulder 346 seated against surface 347. In this configuration, an electrical test may be performed at a manufacturing facility, regional workshop, or a wellsite to determine appropriate connectivity between electrical components. Such an electrical test may confirm actuator assembly 300 depresses mechanical switch 208 and that mechanical switch 208 closes the electrical circuit prior to installing, in some example, a larger module comprising the actuator assembly 300 and the mechanical switch 208 into the downhole tool 125. In some examples, this electrical test may be performed prior to installation within the downhole tool 125, e.g., at the wellsite or at a manufacturing plant.

Figure 6D:
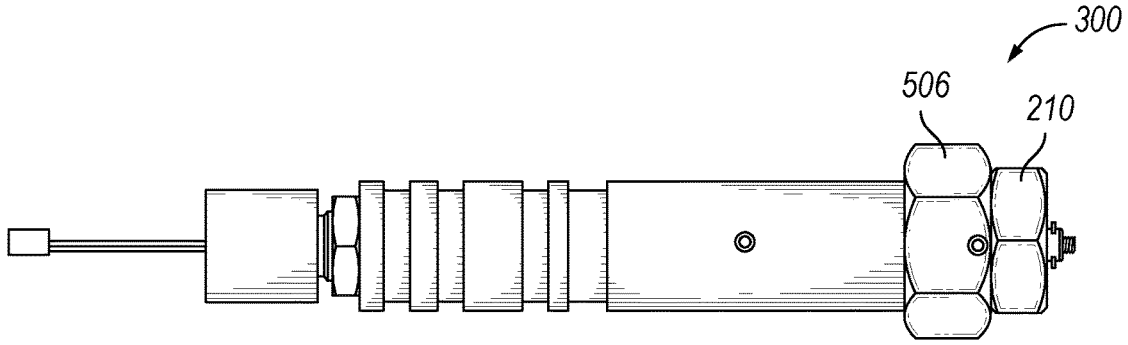
FIG. 6D shows a perspective view of the actuator assembly of FIG. 6C in accordance with some embodiments of the present disclosure.

FIG. 6D shows a perspective view of the actuator assembly of FIG. 6C in accordance with some embodiments of the present disclosure. As illustrated, a downhole side of switch actuator 210 may be seated against, or near to, an uphole side (e.g., wellbore-facing side 358 of FIG. 4A) of flanged portion 506 in the ON position.

Figure 7A:
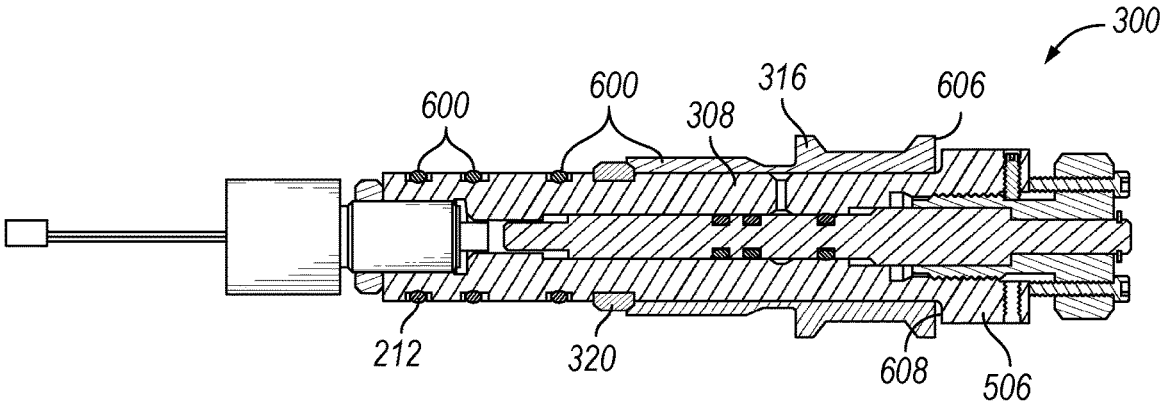
FIG. 7A is a cross sectional view of an actuator assembly in an OFF position to show a power switch actuator disposed in a cartridge subassembly in accordance with some embodiments of the present disclosure.

FIG. 7A is a cross sectional view of an actuator assembly 300 in an OFF position to show a power switch actuator 210 disposed in a cartridge subassembly 600 in accordance with some embodiments of the present disclosure. Cartridge subassembly 600 may, in some examples, provide a replaceable structure (e.g., cartridge) within which actuator assembly 300 is disposed. This may allow for improved ergonomics of assembly as compared to other forms of switch activated downhole tools. Split ring 320 may have a polygonal cross section and be configured to contact spin collar 316.

Figure 7B:
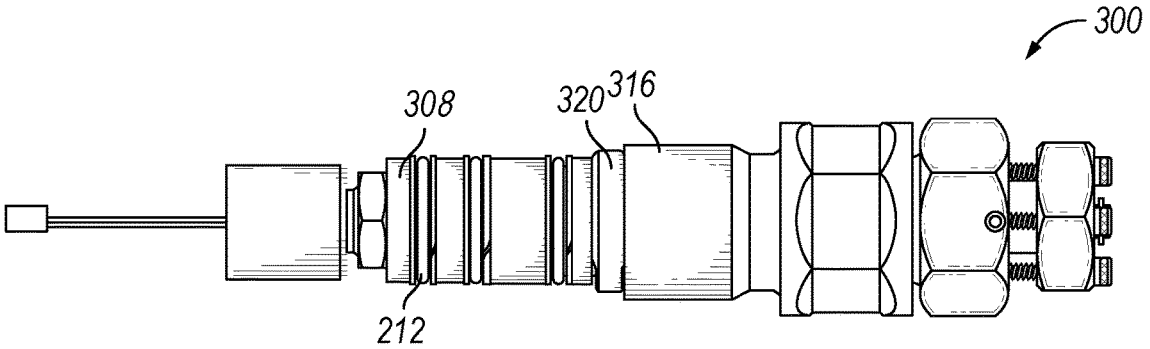
FIG. 7B is a perspective view of the actuator assembly of FIG. 8A in accordance with some embodiments of the present disclosure.

FIG. 7B is a perspective view of the actuator assembly 300 of FIG. 7A in accordance with some embodiments of the present disclosure. This figure shows how spin collar 316 may seat against split ring 320. Also visible are annular sealing elements 212 disposed about respective portions of housing 308.

Figure 8A:
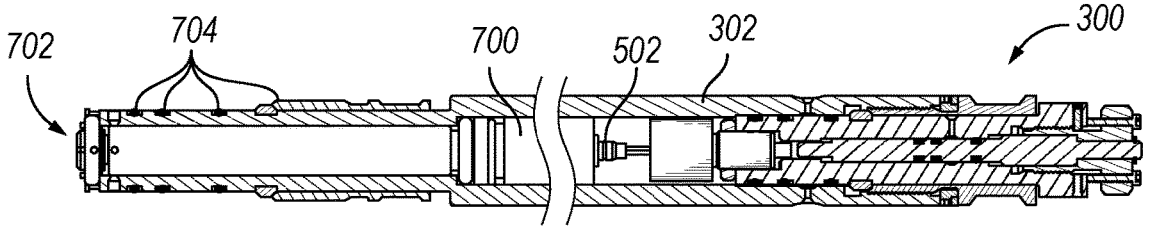
FIG. 8A is a cross sectional view of an actuator assembly in an OFF position and disposed in a pressure housing and connected to an electronic subassembly in accordance with some embodiments of the present disclosure.

FIG. 8A is a cross sectional view of an actuator assembly 300 disposed in pressure housing 302 and in an OFF position in accordance with some embodiments of the present disclosure. This view further shows an electronic subassembly 702 within pressure housing 302. As illustrated, electrical contact point 502 is connected to an electrical component(s) 700 of a downhole tool 125 (e.g., referring to FIG. 1). Electrical component(s) 700 may be, for example, a protected circuit board (PCB), a battery powered tool such as a memory gauge, acoustic repeater, telemetry device, actuator(s), etc., or any battery powered device or electronics, for example. Further downhole from electrical component 700 is an electronic subassembly 702 which may connect to another wiring harness, for example. Electronic subassembly 702 may include, without limitation, an electrical connector. In essence, electronic subassembly 702 may serve to electrically couple the mechanical switch 208 to one or more on-board electronic devices of the downhole tool 125 to allow it to perform its intended function. For example, an electrical connector of electronic subassembly 702 may connect electrical component 700 to one or more resistive loads associated with the intended function(s) of the downhole tool 125 (e.g., referring to FIG. 1), e.g., a wellbore operation such as logging, sensing, sampling, intervention, etc.

This view also shows another cartridge subassembly 704 between electrical component 700 and electronic subassembly 702. Similar to cartridge subassembly 600 (e.g., referring to FIG. 7A, 6B), cartridge subassembly 704 may facilitate assembly/disassembly and may comprise a replaceable cartridge and annular sealing elements.

Figure 8B:
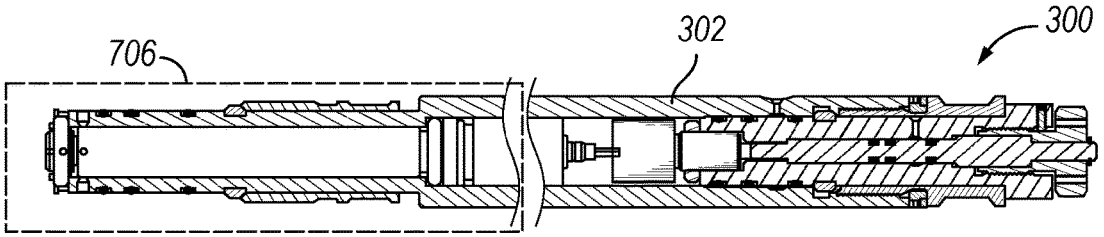
FIG. 8B is cross sectional view of FIG. 8A but in an ON position to show powering of an electrical component of a downhole tool in accordance with some embodiments of the present disclosure.

FIG. 8B is a cross sectional view of the actuator assembly 300 and pressure housing 302 of FIG. 8A, but with actuator assembly 300 in an ON position in accordance with some embodiments of the present disclosure. In the ON position 413 (e.g., referring to FIG. 5B), the electrical component(s) 700 is/are powered allowing the tool to be powered and thus the specific actions of the tool to be performed after or during the tool is/is being lowered to its target depth(s) in the wellbore. The area indicated at 706 may be entirely disposed within the downhole tool 125 (e.g., referring to FIG. 1).

In an alternative embodiment, rather than a switch actuator to actuate the switch, another method may include pushing a switch mechanism. In examples, mechanical switch 208 may have a fixed position within downhole tool 125 (e.g., referring to FIG. 1). In examples, plunger driver 328 and snap ring 330 (e.g., referring to FIG. 4A) may be removed and switch plunger 202 redesigned as a hex, or other feature, to enable rotational engagement of threads within downhole tool 125 to move switch plunger 202 to "push" the mechanical switch 208. In some examples, this may additionally, or alternatively, involve omitting threads of pressure housing 206 so that switch plunger 202 may be linearly actuated directly. For example, plunger driver 328, snap ring 330, anti-rotation screws 410, and threads (e.g., of pressure housing 206) may be omitted and switch plunger 202 may be manually depressed from outside the tool (e.g., at surface 306 of FIG. 4A) prior to running the tool in the wellbore, or else depressed by downhole pressure acting on a piston area (e.g. at surface 306 of FIG. 4A) of switch plunger 202, e.g., once the external pressure rises to a pre-determined threshold. Actuating mechanical switch 208 with switch plunger 202 directly with wellbore pressure may further postpone activating the tool and thus prolong the operating time of the tool even further by causing on-board batteries to not power the tool until sometime after downhole tool 125 has been introduced into the wellbore or traveled beyond a target depth (e.g., at least 1 meter, at least 10 meters, at least 25 meters, etc.) with an associated threshold pressure sufficient to actuate the tool. For example, this could be achieved by disposing a threshold pressure element (e.g., spring, rupture disk, shear screw, elastic band, etc.) in the downhole tool 125, having a specific property (e.g., elastic modulus, rupture pressure, breaking pressure, compressive strength, tensile strength, etc.) such that the tool is not powered until wellbore pressure overcomes the property of the threshold pressure element. Where the threshold pressure element is a spring, such may be disposed about the major outer diameter of switch plunger 202 at an area between shoulder 346 and surface 347, for example.

In another alternative embodiment, rather than extended and non-extended positions of the switch plunger 202 (e.g., referring to FIG. 3) corresponding to ON and OFF positions (e.g., of mechanical switch 208 of FIG. 3), respectively, these may instead correspond to OFF and ON positions, respectively. For example, the mechanical switch 208 (e.g., referring to FIG. 3) may be biased in a reverse direction relative to the configuration shown by the figures.

In other alternative embodiments, rather than having only a dual position, i.e., the ON and OFF positions, actuator assembly 300 (e.g., referring to FIG. 3) may be configured to switch between a plurality (e.g., 3, 4, 5, 6, 10, etc., or any ranges therebetween) of switch settings. For example, a corresponding plurality of actuation distances of switch plunger 202 (e.g., referring to FIG. 3) may each correspond to a separate position or configuration associated with a different setting of the downhole tool 125 (e.g., referring to FIG. 1).

In another alternative embodiment, the mechanical switch 208 may itself be rotated to change between ON and OFF positions. For example, contact surface 307 of switch plunger 202 (e.g., referring to FIG. 4A) may be machined to match a rotation shaft (not shown) for interfacing with mechanical switch 208. Switch plunger 202 may include, for example wrench flats, a hex socket, splines, or other features enabling the mechanical switch 208 to be turned, which may allow for actuation of the mechanical switch 208 via rotation of the rotation shaft and switch plunger 202. In some examples, this may be achieved with a roller lever to actuate the mechanical switch 208, for example, by pushing a lever arm of the roller lever with a roller disposed at an interface between switch plunger 202 and the lever arm. Thus, an axial motion of switch plunger 202 may cause rotational movement of the lever arm of a roller lever which may, in some examples, increase the range of motion of the switch plunger 202 relative to other disclosed embodiments.

Figure 9A:
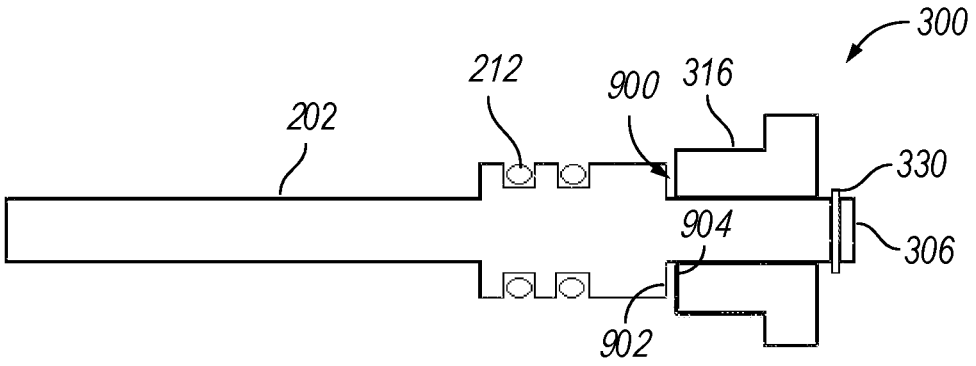
FIG. 9A is a cross sectional view of an actuator assembly having a spin collar and a switch plunger, and in an OFF position in accordance with some embodiments of the present disclosure. As mentioned, an actuator assembly may

FIG. 9A is a cross sectional view of an actuator assembly 300 having a spin collar 316 and a switch plunger 202, and in an OFF position in accordance with some embodiments of the present disclosure. Rather than pushing on a split ring (e.g., split ring 320 of FIG. 4A), an actuator assembly 300 may be configured such that actuation of mechanical switch 208 (e.g., referring to FIG. 4A) is instead achieved by imparting linear movement directly to switch plunger 202 by spin collar 316. In the illustrated OFF position, there may be a gap 900 between a shoulder 902 of switch plunger 202 and a contact surface 904 of spin collar. This figure also shows annular sealing elements 212 disposed about switch plunger 202, as well as snap ring 330 and surface 306.

Figure 9B:
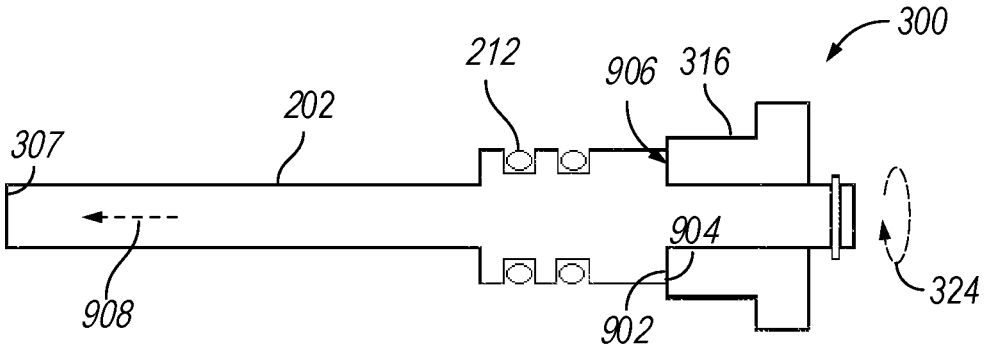
FIG. 9B is a cross sectional view of the actuator assembly of FIG. 9B with the spin collar seated against a shoulder of the switch plunger, and in an ON position in accordance with some embodiments of the present disclosure.

FIG. 9B is a cross sectional view of the actuator assembly of FIG. 9B with the spin collar 316 seated against the shoulder 902 of the switch plunger 202, and in an ON position in accordance with some embodiments of the present disclosure. As illustrated, the gap 900 (e.g., referring to FIG. 9A) is removed so that, as spin collar 316 is rotated downwards as indicated by the dotted line at 324, it directly pushes the switch plunger 202 in the downhole direction towards mechanical switch 208 (e.g., referring to FIG. 3A). Sealing elements 212 may thus maintain an effective seal that isolates contact surface 707 from wellbore pressure at surface 306 (e.g., referring to FIG. 9A).

Advantageously, the present disclosure may provide an example actuator assembly that may be mechanically actuated at a rig floor without the need for external or internal power to actuate the assembly. Further, example actuator assemblies and related structures may be manufactured with components free or essentially free of materials susceptible to de-magnetization, while still allowing for pressure isolation of internal regions of downhole tools. These may eliminate or reduce the need for complex and time-consuming pressure testing procedures during make-up of a tool string. The methods and systems may include any of the various features disclosed herein, including one or more of the following statements.

Statement 1: An actuator assembly, comprising: a plunger housing; a switch plunger disposed within the plunger housing; and a switch actuator configured to induce linear movement of the switch plunger along the plunger housing, wherein the actuator assembly is configured to: change between an ON position and an OFF position by moving the switch plunger between extended and non-extended positions; and maintain a first pressure at one end of the switch plunger when an outer portion of the actuator assembly is exposed to a second pressure greater than the first pressure.

Statement 2: The actuator assembly of statement 1, wherein the first and second pressures are atmospheric and downhole pressures, respectively.

Statement 3: The actuator assembly of statements 1 or 2, wherein the outer portion of the actuator assembly comprises the switch actuator and/or another end of the switch plunger.

Statement 4: The actuator assembly of any of statements 1-3, further comprising one or more annular sealing elements disposed between the switch plunger and an inner surface of the plunger housing.

Statement 5: The actuator assembly of any of statements 1-4, wherein at least two annular sealing elements are disposed at one or more regions of the switch plunger downhole a pressure test port extending radially through the plunger housing.

Statement 6: The actuator assembly of any of statements 1-5, further comprising one or more seating surfaces of the switch plunger and one or more corresponding shoulders of the plunger housing for limiting over-insertion of the switch plunger past the ON position.

Statement 7: The actuator assembly of any of statements 1-6, further comprising one or more anti-rotation screws disposed in the switch actuator.

Statement 8: The actuator assembly of any of statements 1-7, disposed in a cartridge subassembly, the cartridge subassembly comprising: a split ring configured to slide under a spin collar; the spin collar; and two or more additional annular sealing elements disposed within respective annular grooves on the outside of the housing of the actuator assembly below the spin collar.

Statement 9: The actuator assembly of statement 8, wherein the split ring has a polygonal cross section and is disposed substantially adjacent to the spin collar when the actuator assembly and the cartridge subassembly are disposed within a pressure housing of a downhole tool.

Statement 10: The actuator assembly of any of statements 1-7, wherein the switch plunger comprises a shoulder, wherein the shoulder is pushed on by a contact surface of a spin collar disposed around at least a portion of the actuator assembly.

Statement 11: The actuator assembly of any of statements 1-10, further comprising an ON-OFF switch jam nut disposed near or at the mechanical switch to fix a position of the mechanical switch relative to the switch plunger.

Statement 12: A method, comprising: inducing linear movement of a switch plunger along a plunger housing of an actuator assembly to actuate a mechanical switch; powering a downhole tool with one or more on-board batteries as a result of the linear movement, and introducing the downhole tool into a wellbore; and maintaining a region housing the mechanical switch at a stable pressure that is less than a wellbore pressure while the powered tool is disposed in the wellbore.

Statement 13: The method of statement 12, wherein the region comprising the mechanical switch is a chamber maintained at or near atmospheric pressure while the downhole tool is lowered to a depth greater than 500 feet, and wherein the wellbore pressure exceeds 500 pounds per square inch.

Statement 14: The method of statements 12 or 13, further comprising seating one or more contacting surfaces of the switch plunger against one or more corresponding shoulders of the plunger housing to prevent over-insertion of the switch plunger.

Statement 15: The method of any of statements 12-14, further comprising removing one or more anti-rotation screws from the switch actuator prior to initially inducing the linear movement of the switch plunger.

Statement 16: The method of any of statements 12-15, further comprising fixing an axial configuration of the switch plunger with one or more additional anti-rotation screws after changing from an OFF position to an ON position.

Statement 17: The method of any of statements 12-16, wherein inducing linear movement of the switch plunger to change from the OFF position to the ON position is performed without an external or internal power source, and wherein after the actuator assembly is installed in the downhole tool, the downhole tool is not pressure tested before being introduced to the wellbore.

Statement 18: A tool string, comprising: a conveyance for suspending a downhole tool in a wellbore; the downhole tool, comprising: a mechanical switch disposed within a pressure sealed chamber; and an actuator assembly, comprising: a switch plunger disposed within a housing and configured to actuate the mechanical switch from outside the downhole tool via linear movement along a housing; a battery module connected to, or disposed within, the downhole tool.

Statement 19: The tool string of statement 18, wherein the actuator assembly is configured such that actuation of the mechanical switch is performed without any need for external power and/or pressure testing.

Statement 20: The tool string of statements 18 or 19, wherein the downhole tool further comprises: a replaceable cartridge between the actuator assembly and a pressure housing a connector coupled to the mechanical switch in the pressure sealed chamber; one or more annular sealing elements between the switch plunger and the housing; one or more additional annular scaling elements between the actuator assembly and the pressure housing; and a snap ring disposed on an end of the switch plunger and in contact with the switch actuator.

Statement 21: The tool string of any of statements 18-20, the tool string further comprising: one or more additional actuator assemblies, each comprising a switch plunger disposed within a housing and configured to actuate another respective mechanical switch from outside the downhole tool via rotation of another respective switch actuator; and one or more additional battery modules connected to the downhole tool for every additional actuator assembly.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. An actuator assembly, comprising:

a plunger housing;

a switch plunger disposed within the plunger housing; and a switch actuator configured to induce linear movement of the switch plunger along the plunger housing, wherein the actuator assembly is configured to:

change between an ON position and an OFF position by moving the switch plunger between extended and non-extended positions;

maintain a first pressure at one end of the switch plunger when an outer portion of the actuator assembly is exposed to a second pressure greater than the first pressure, and a cartridge subassembly disposed on an outer surface the plunger housing, wherein the cartridge subassembly includes a spin collar and a split ring, and wherein the split ring is configured to slide under the spin collar.

2. The actuator assembly of claim 1, wherein the first and second pressures are atmospheric and downhole pressures, respectively.

3. The actuator assembly of claim 1, wherein the outer portion of the actuator assembly comprises the switch actuator, wherein the switch actuator comprises a rotatable flanged portion.

4. The actuator assembly of claim 1, further comprising one or more annular sealing elements disposed between the switch plunger and an inner surface of the plunger housing.

5. The actuator assembly of claim 1, wherein at least two annular sealing elements are disposed at one or more regions of the switch plunger downhole of a pressure test port extending radially through the plunger housing.

6. The actuator assembly of claim 1, further comprising one or more seating surfaces of the switch plunger and one or more corresponding shoulders of the plunger housing for limiting over-insertion of the switch plunger past the ON position.

7. The actuator assembly of claim 1, further comprising one or more anti-rotation screws disposed in the switch actuator.

8. The actuator assembly of claim 1, wherein the cartridge subassembly further includes two or more additional annular sealing elements disposed within respective annular grooves on the outside of a housing of the actuator assembly below the spin collar.

9. The actuator assembly of claim 1, wherein the split ring has a polygonal cross section and is disposed substantially adjacent to the spin collar when the actuator assembly and the cartridge subassembly are disposed within a pressure housing of a downhole tool.

10. The actuator assembly of claim 1, wherein the switch plunger comprises a shoulder, wherein the shoulder is pushed on by a contact surface of the spin collar disposed around at least a portion of the actuator assembly.

11. The actuator assembly of claim 1, further comprising an ON-OFF switch jam nut disposed near or at a mechanical switch to fix a position of the mechanical switch relative to the switch plunger.

12. A method, comprising:

inducing linear movement of a switch plunger along a plunger housing of an actuator assembly to actuate a mechanical switch, wherein inducing linear movement of the switch plunger to change from the OFF position to the ON position is performed without an external or internal power source, and wherein after the actuator assembly is installed in the downhole tool, the region housing the mechanical switch is not pressure tested before the downhole tool is introduced into the wellbore;

fixing an axial configuration of the switch plunger with one or more additional anti-rotation screws after changing from an OFF position to an ON position;

powering a downhole tool with one or more on-board batteries as a result of the linear movement, and introducing the downhole tool into a wellbore; and maintaining a region housing the mechanical switch at a stable pressure that is less than a wellbore pressure while the powered tool is disposed in the wellbore.

13. The method of claim 12, wherein the region comprising the mechanical switch is a chamber maintained at or near atmospheric pressure while the downhole tool is lowered to a depth greater than 500 feet, and wherein the wellbore pressure exceeds 500 pounds per square inch.

14. The method of claim 12, further comprising seating one or more contacting surfaces of the switch plunger against one or more corresponding shoulders of the plunger housing to prevent over-insertion of the switch plunger.

15. The method of claim 12, further comprising removing one or more anti-rotation screws from the actuator assembly to allow for the inducing linear movement of the switch plunger.

16. A tool string, comprising:

a conveyance for suspending a downhole tool in a wellbore;

the downhole tool, comprising:

a mechanical switch disposed within a pressure sealed chamber, wherein the mechanical switch is configured to actuate between an ON position and an OFF position, wherein the mechanical switch is configured to close part of a circuit in the ON position; and an actuator assembly, comprising:

a switch plunger disposed within a plunger housing and configured to actuate the mechanical switch from outside the downhole tool via linear movement along the housing, wherein linear movement of the switch plunger is induced outside of the wellbore and without an external or internal power source; and a switch actuator disposed at least partially within the plunger housing wherein the switch actuator is configured to move linearly along the plunger housing in response to manual rotation the switch actuator, wherein the switch actuator is configured to interface with the switch plunger such that linear movement the switch actuator is configured to induce linear movement of the switch plunger along the plunger housing; and a battery module connected to, or disposed within, the downhole tool, and wherein the battery module is connected to the circuit.

17. The tool string of claim 16, wherein the actuator assembly is configured such that actuation of the mechanical switch is performed without any need for external pressure testing.

18. The tool string of claim 16, wherein the downhole tool further comprises:

a replaceable cartridge between the actuator assembly and a pressure housing a connector coupled to the mechanical switch in the pressure sealed chamber;

one or more annular sealing elements between the switch plunger and the housing;

one or more additional annular sealing elements between the actuator assembly and the pressure housing; and a snap ring disposed on an end of the switch plunger and in contact with the switch actuator.

19. The tool string of claim 16, the tool string further comprising:

one or more additional actuator assemblies, each comprising a switch plunger disposed within a housing and configured to actuate another respective mechanical switch from outside the downhole tool via rotation of another respective switch actuator, and one or more additional battery modules connected to the downhole tool for every additional actuator assembly.

* * * * *